US006604663B2

(12) United States Patent
Kuwano et al.

(10) Patent No.: US 6,604,663 B2
(45) Date of Patent: Aug. 12, 2003

(54) CONTROL METHOD OF HYDRAULIC PINCH ROLL AND CONTROL UNIT THEREOF

(75) Inventors: Hiroaki Kuwano, Yokosuka (JP); Kouji Shirakawa, Yokohama (JP)

(73) Assignee: Ishikawajima-Harima Heavy Industries Co., Ltd., Tokyo (JP)

( * ) Notice: Subject to any disclaimer, the term of this patent is extended or adjusted under 35 U.S.C. 154(b) by 0 days.

(21) Appl. No.: 09/930,965

(22) Filed: Aug. 17, 2001

(65) Prior Publication Data

US 2003/0034376 A1 Feb. 20, 2003

(51) Int. Cl.[7] ..... B65H 20/02; B21B 37/58; B23Q 15/06

(52) U.S. Cl. ..... 226/177; 226/21; 226/187; 72/9.3; 72/11.9

(58) Field of Search ..... 226/177, 187, 226/21; 72/9.3, 11.9

(56) References Cited

U.S. PATENT DOCUMENTS

| | | | | |
|---|---|---|---|---|
| 4,759,205 A | | 7/1988 | Kuwano et al. | |
| 5,231,858 A | * | 8/1993 | Yamashita et al. | 72/11.9 |
| 5,868,296 A | * | 2/1999 | Gentile et al. | 226/187 X |
| 6,185,971 B1 | * | 2/2001 | Kuwano et al. | 72/205 |
| 6,301,946 B1 | * | 10/2001 | Kukizaki et al. | 72/148 |

FOREIGN PATENT DOCUMENTS

| | | | |
|---|---|---|---|
| EP | 1 016 471 A1 | * | 7/2000 |
| JP | 8-52514 | * | 2/1996 |
| JP | 9-267126 | * | 10/1997 |

OTHER PUBLICATIONS

Patent Abstracts of Japan, vol. 1998, No. 2, Jan. 30, 1998 & JP 09 267126 A (Kawasaki Steel Corp.), Oct. 14, 1997.

Patent Abstracts of Japan, vol. 1996, No. 06, Jun. 28, 1996 & JP 08 052514 A (Ishikawajima Harima Heavy Industries Co. Ltd.; others: 01), Feb. 27, 1996.

Patent Abstracts of Japan, vol. 1995, No. 11, Dec. 26, 1995 & JP 07 214156 A (Ishikawajima Harima Heavy Industries Co. Ltd.; others: 01), Aug. 15, 1995.

* cited by examiner

*Primary Examiner*—Kathy Matecki
*Assistant Examiner*—Minh-Chau Pham
(74) *Attorney, Agent, or Firm*—Griffin & Szipl, P.C.

(57) ABSTRACT

A control unit of hydraulic pinch rolls 1 comprises: position detectors 10*c*, 10*d* that detect position of right and left cylinder pistons 6*c*; an arithmetical unit 13 that calculates a difference of output 16*c*, 16*d* from the position detectors; a controller 14 that processes a calculated value to make correction output; and add-subtract units 18*c*, 18*d* that add/subtract the correction output from the controller such that the correction output 17 is added to an end portion of the pinch rolls having a wider gap in a direction to push the gap and the correction output of the same amount is subtracted from the opposite end portion, by which the set values of pressing force control provided for right and left independently are corrected. Thus, a defective winding shape can be suppressed.

5 Claims, 8 Drawing Sheets

CONTROL METHOD OF HYDRAULIC PINCH ROLL AND CONTROL UNIT THEREOF

BACKGROUND OF THE INVENTION

1. Field of the Invention

The present invention relates to a method of improving a winding shape of a coil to be wound by a down coiler by hydraulic pinch rolls controlled by a hydraulic cylinder and a servo valve and to a control unit thereof.

2. Description of the Related Art

FIG. 1 shows pinch rolls 1, including upper pinch roll 1*a* and lower pinch roll 1*b*, of a down coiler 2 of hot rolling equipment being a subject of the present invention. In the hot rolling equipment, a strip 4 that has been rolled to a predetermined plate thickness by a finishing mill 3 is rolled by the down coiler to be an end item in a coil state. The pinch rolls 1*a*, 1*b* function to guide a strip 4 run on a table roller 5 to the down coiler 2.

Recently, as shown in FIG. 2, a hydraulic pinch roll that controls the position of upper and lower pinch rolls and a pressing force to the strip by a hydraulic cylinder 6 and a servo valve 7 has been commercialized. Function required to such pinch rolls 1 is stretching the strip 4 to guide to the down coiler 2 in an initial period of the winding and stretching the strip 4 in an opposite direction to maintain an appropriate tension with a mandrel 2*e* after the strip 4 has been wound to the mandrel 2*e*. Accordingly, an appropriate force is given to the pinch rolls 1 to press the strip 4.

The hydraulic pinch rolls 1 shown in FIG. 2 is constituted as follows. Specifically, right/left chucks 1*c* and 1*d* of an upper pinch roll 1*a* is supported by the hydraulic cylinder 6 and control of excurrent/incurrent of oil to the hydraulic cylinder 6 is performed by the servo valve 7 connected via piping 8*a* and 8*b*. Pressure detector 9*a* and 9*b* are severally connected to the piping 8*a* and 8*b* so that the pressure of the hydraulic cylinder 6 at a head side 6*a* and a rod side 6*b* can be detected. Moreover, position detectors 10*c* and 10*d* can detect the position of a piston 6*c* of the hydraulic cylinder 6.

In the hydraulic pinch rolls 1, an initial gap is set by detecting the position of the piston 6*c* of the hydraulic cylinder 6 by the position detectors 10*c* and 10*d* and by controlling the position of the upper pinch roll 1*a* based on the signal of the detection. After the strip 4 bounces into the pinch rolls 1 to be guided to the down coiler 2, a positional control is switched to a pressing force control in an appropriate timing, and a pressing force arithmetical unit 11 calculates the pressing force to the strip 4 of the upper pinch roll 1*a* based on the pressure of the head and rod sides 6*a* and 6*b*, which has been detected by the pressure detectors 9*a* and 9*b*, and then a servo controller 12 sends an instruction to a servo valve 7 based on the signal of the calculation to control the pressing force.

In a conventional down coiler 2, a defective winding shape of the coil (a telescope), as shown in FIG. 3, has occurred due to reasons such as the case where a plane shape of the strip 4 to be wound is bad and where the strip 4 enters the pinch rolls 1 in an off-center manner. Furthermore, recently, when a wide and hard material is wound, a problem of multiple defective winding shapes as shown in FIG. 4 in which an end surface of a wound coil has an iterative unevenness.

SUMMARY OF THE INVENTION

In consideration of the foregoing circumstances, the object of the present invention is to provide a control method of the hydraulic pinch rolls that can suppress the defective winding shape and a control unit thereof.

The inventor of the present invention has found out that the right/left difference of a piston position of the hydraulic pinch rolls, that is, the output difference of the position detectors 10*c* and 10*d* shows a periodic fluctuation when the defective winding shape occurs where the end surface of the wound coil has an iterative unevenness, and that the output difference does not show the periodic fluctuation when the defective winding shape does not occur.

Accordingly, in a first embodiment of the present invention, the control unit of the hydraulic pinch rolls is constituted such that the pressing force of the right and the left of the pinch rolls is changed moment by moment in accordance with the output difference of the position detectors 10*c* and 10*d* and the fluctuation shown in the output difference of the position detectors 10*c* and 10*d* can be suppressed. As a result, a gap fluctuation that occurs alternately in right and left (a seesaw state) on the upper pinch roll 1*a* of the hydraulic pinch rolls 1 can be prevented.

In a second embodiment of the present invention, since the control unit of the hydraulic pinch rolls 1 changes the gaps of the right and left of the pinch rolls by positional control moment by moment in accordance with the pressing force of the pinch rolls obtained from the output of the pressure detectors 9*a* and 9*b*, the gap of the pinch rolls is maintained parallelly. Accordingly, the gap fluctuation that occurs alternately in right and left on the upper pinch roll 1*a* can be prevented. As a result, the defective winding shape where the end surface of a wound coil iterates the periodical unevenness can be prevented.

Other objects and advantageous characteristic of the present invention will be made clear by the following description with reference to the accompanied drawings.

DESCRIPTION OF THE PREFERRED EMBODIMENTS

Figure 1:
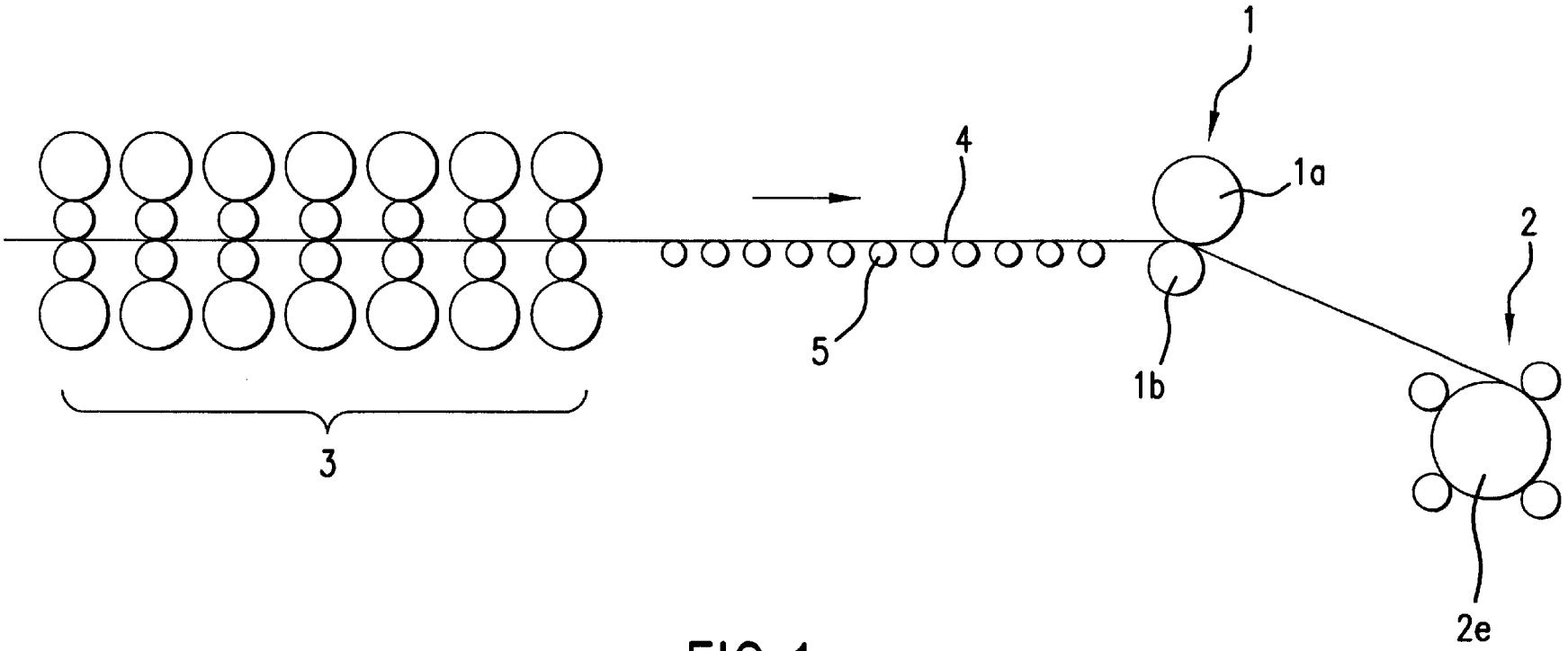
FIG.1 PRIOR ART
FIG. 1 is a constitutional view of a hot rolling equipment including conventional hydraulic pinch rolls.
Figure 2:
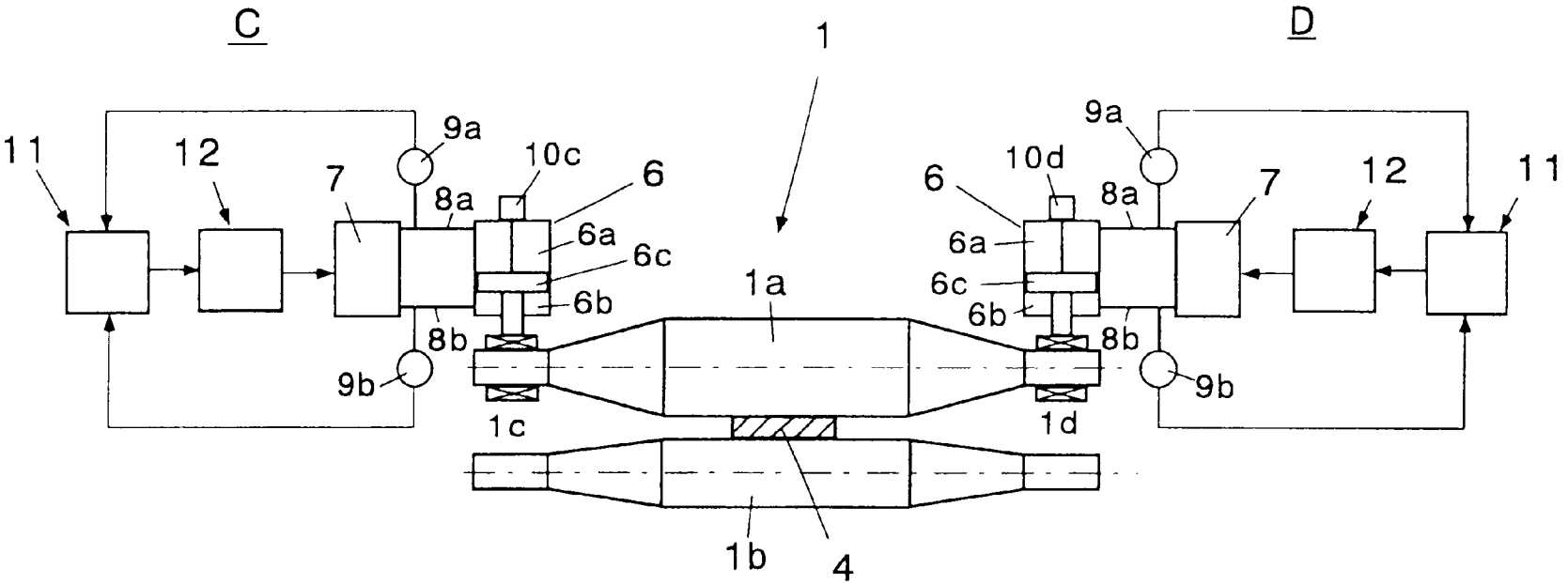
Fig.2 (Prior Art)
FIG. 2 is a constitutional view of conventional pinch rolls.
Figure 3:
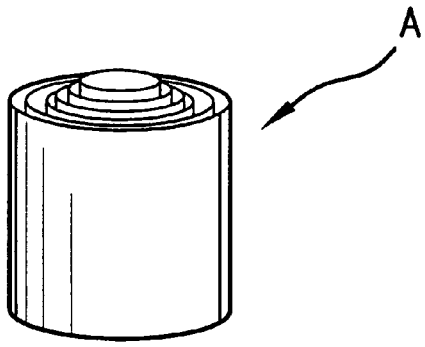
FIG. 3 is an explanatory view of a defective winding shape (a telescope) of a coil A.
Figure 4:
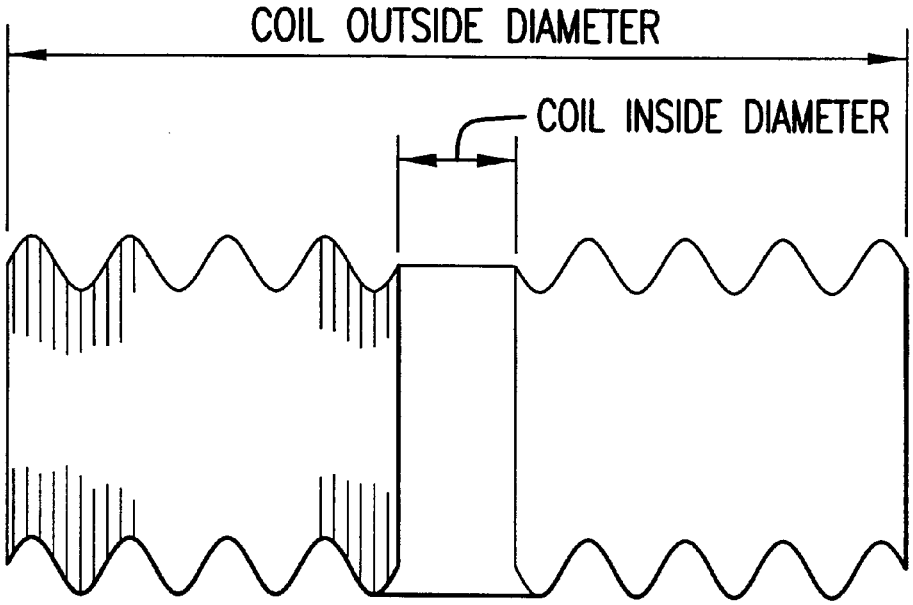
FIG. 4 is an explanatory view of another defective winding shape of the coil.
Figure 5:
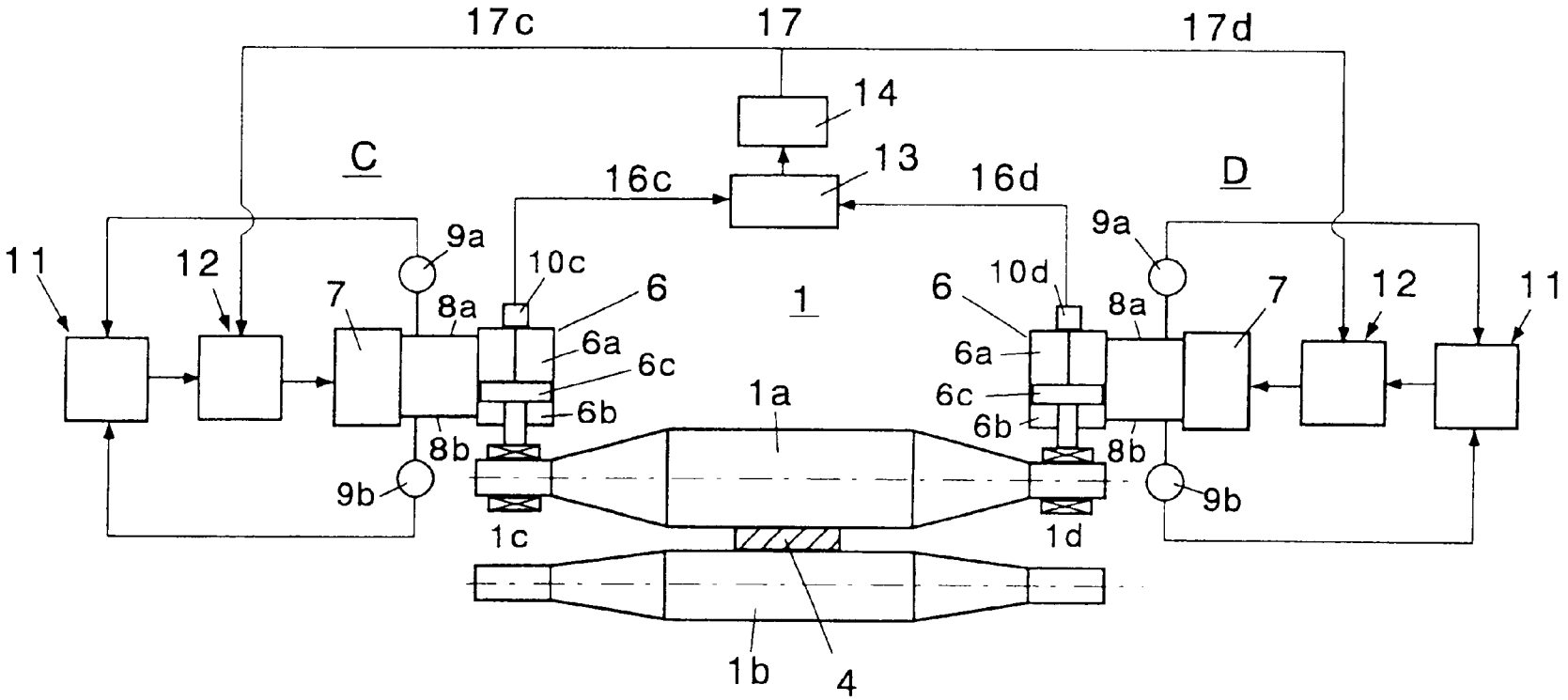
FIG. 5 is an entire constitutional view of hydraulic pinch roll unit including upper pinch roll 1*a*, lower pinch roll 1*b*, and a control unit of the present invention.

FIG. 5 shows the entire constitutional view of a first embodiment of the pinch rolls of the present invention, the same reference numerals are given to common portions to FIG. 2, and redundant explanation will be omitted.

In the apparatus of the present invention, the pressing force of the upper pinch roll 1*a* to the strip 4 is controlled by pressing force control units C and D independently provided for right and left, similarly to the conventional apparatus of FIG. 2. Specifically, from the pressure of the head side 6*a* and the rod side 6*b* ($P_a$ and $P_b$, respectively) of the hydraulic cylinder 6, the pressure having been detected by the pressure detectors 9*a* and 9*b* provided in mid course of the piping 8*a* and 8*b*, the arithmetical units 11 calculate a pressing force F generated by the hydraulic cylinders 6 as in $F=P_a \times A_h - P_b \times A_1$ (where $A_h$ and $A_1$ show the area of the piston 6*c* in the head side and the rod side respectively). Then, a calculated value is compared with a set value by the controller 12, the servo valve 7 is driven based on the difference between the values to control the excurrent/incurrent of the oil to the hydraulic cylinder 6, and the pressing force F is controlled so as to be a predetermined value.

Figure 6:
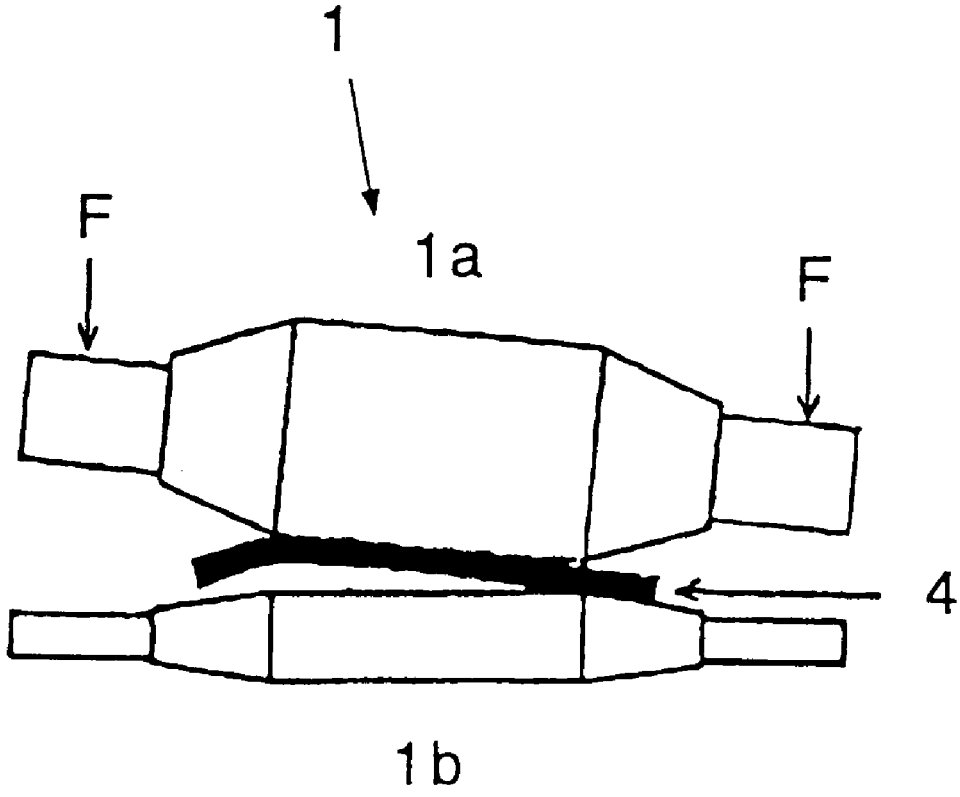
FIG. 6 is a typical view of a case where the gap of one side of pinch rolls 1*a*, 1*b* is wide.

In the conventional apparatus, the pressing force of the right and left was merely controlled independently. Accordingly, as shown in FIG. 6, since the pressing force in the right and left is severally controlled so as to be constant even if the thick strip 4 is tilted between the gap of the pinch rolls 1, the upper pinch roll 1*a* tilts accordingly, and thus the right and left difference of a roll gap could not eliminated. Therefore, occurrence of the gap fluctuation could not be suppressed because the strip 4 moves in the right and left direction between the gap of the pinch rolls, and thus the defective winding shape in which the end surface of the wound coil iterates unevenness periodically.

In addition to the conventional apparatus, the apparatus of the present invention shown in FIG. 5 is constituted such that an arithmetical unit 13 performs an operation for the difference of output 16*c* and 16*d* from the position detection units 10*c* and 10*d* detecting the position of the right and left cylinder pistons 6*c*, a controller 14 processes a calculated value, and its output 17, dividable into outputs 17*c* and 17*d*, is applied to the right and left pressing force controller 12.

Figure 7:
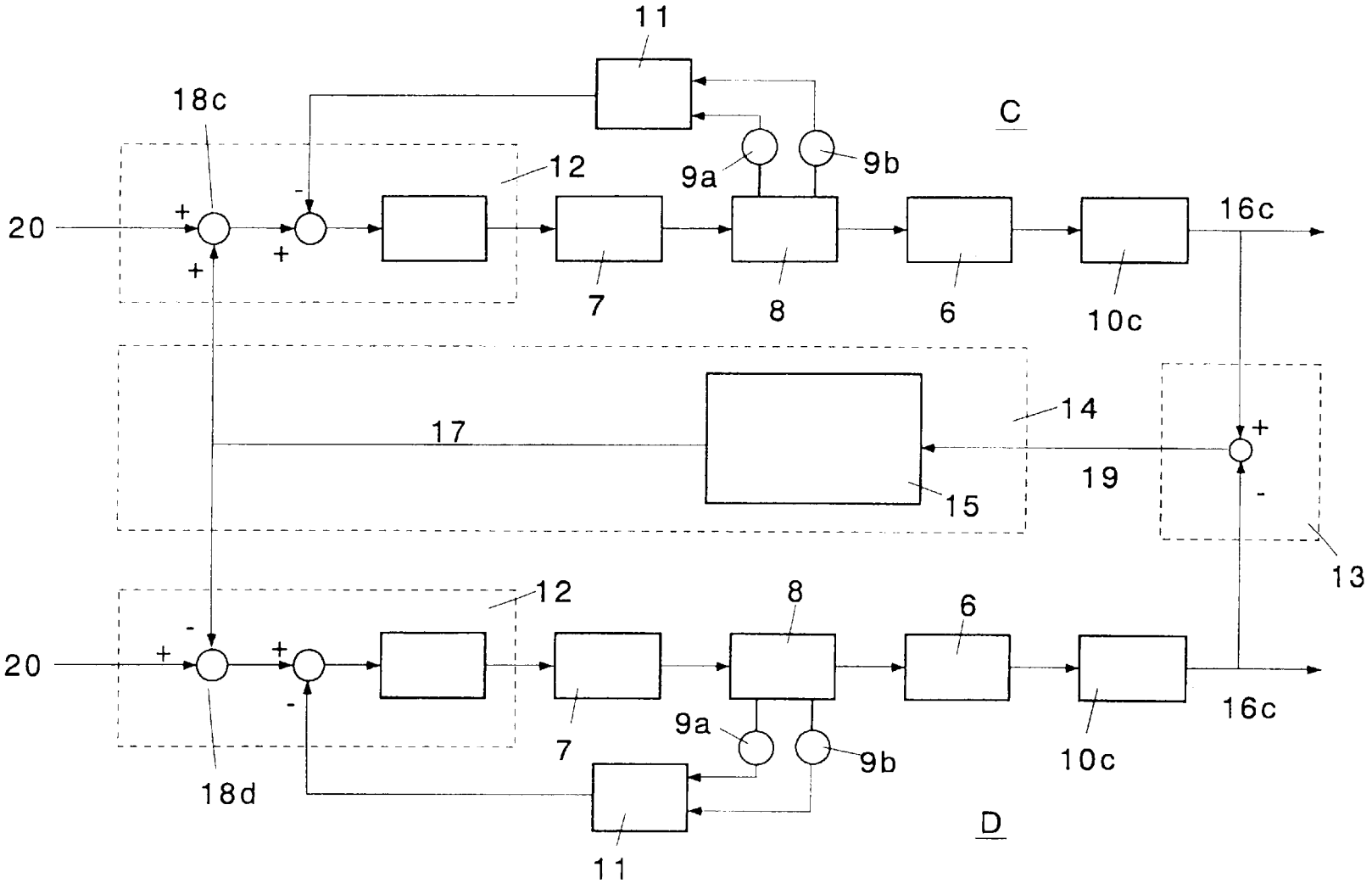
FIG. 7 is a block diagram of the control unit of hydraulic pinch rolls in accordance with the present invention.

The control unit of the present invention will be described in more detail by the block diagram of FIG. 7. In FIG. 7, the control unit is constituted such that correction output 17 by the controller 14 of the present invention is added to pressing values 20 of the foregoing right and left pressing force control units C and D independently provided. Regarding the correction output 17, in the case where the left gap of the pinch roll 1 is wide, as shown in FIG. 6, add-subtract units 18*c* and 18*d* built in the controller 12 perform addition-subtraction to a pressing force set value 20 such that the correction output 17 is added to push down the gap and the correction out put 17 of the same amount is subtracted from the gap of the other side. Accordingly, the wider gap is pushed down by the correction output 17 and the other gap is lightened by the amount of the correction output 17 without changing a total load to press the strip 4. Thus, fluctuation does not occur in the difference of the right and left gaps.

Figure 8A:
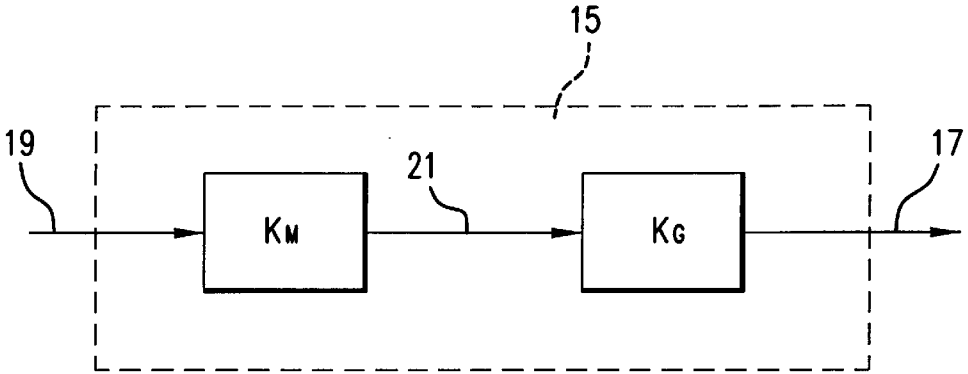
FIG. 8A and FIG. 8B are examples of a main arithmetical unit of the control unit of the present invention.
Figure 8B:
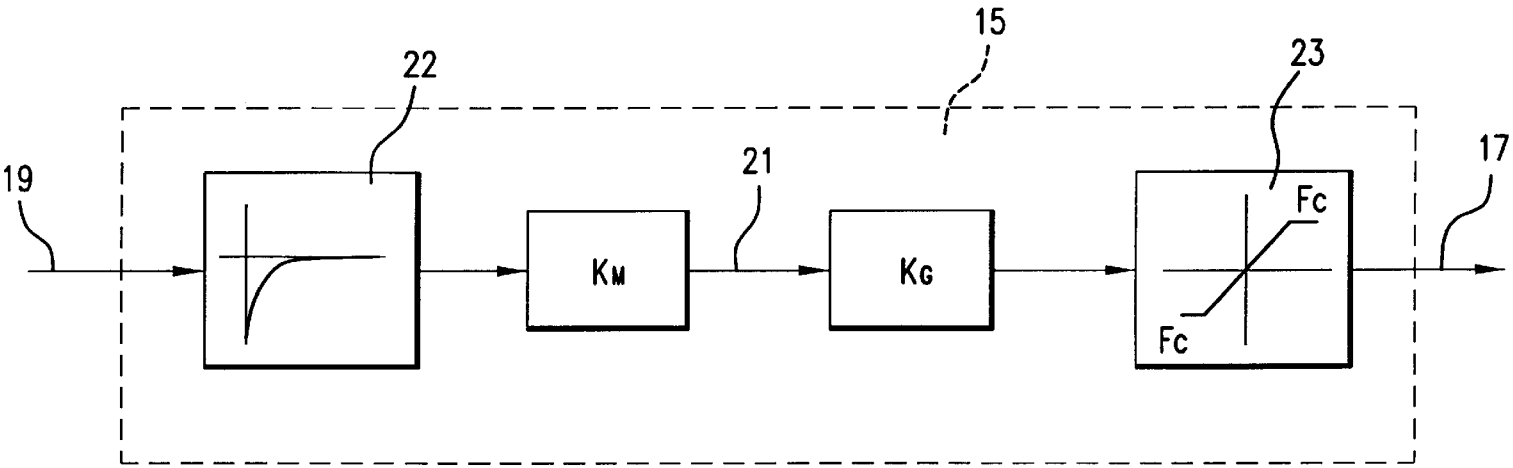

FIG. 8A and FIG. 8B show a constitutional examples of a main arithmetical unit 15 in the controller 14 of the present invention. FIG. 8A show a basic constitution in which the difference of the right and left cylinder piston positions 19 is multiplied by a spring constant $K_M$ of a tilt of a mechanical system of the pinch rolls 1 in the right and left directions to convert to a change 21 of force, and a proper control gain $K_G$ is further multiplied to make the correction value 17 of the right and left pressing force set values.

FIG. 8B is a constitution where a high-pass filter 22 and a clamping circuit 23 are added to an input side and an output side respectively. The high-pass filter 22 takes out only a fluctuation amount from the right and left difference of the cylinder piston positions, and the clamping circuit 23 is a safety circuit to prevent the correction output 17 from exceeding a previously set value $\pm F_c$.

Figure 9:
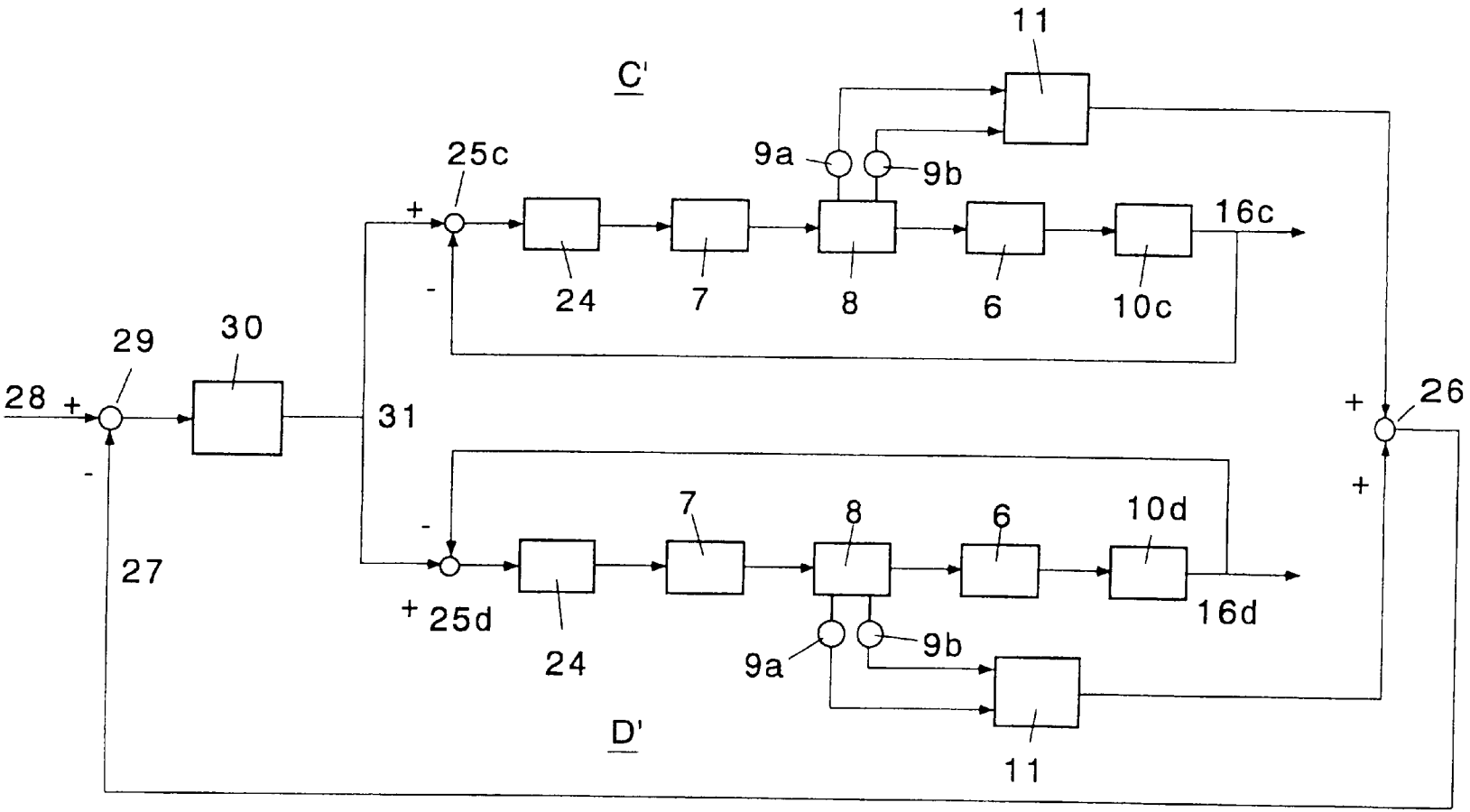
FIG. 9 is a block diagram showing a second embodiment of the control unit of the present invention.

FIG. 9 shows a second embodiment of the present invention. In the embodiment, positional control units C' and D', which control the position of the cylinder pistons 6C, that is, the right and left roll gaps based on the output from the position detectors 10*c* and 10*d* detecting the position of the cylinder pistons 6*c*, are provided independently for the right and left. Then, output 31 obtained by processing the difference between a set value 28 of the pressing force of the pinch rolls and a pressing force 27 actually detected by a controller 30 is supplied to the positional control units as the instruction value of the positional control.

Specifically, regarding the gaps at the right and left of the hydraulic pinch rolls, add-subtract units 25*c* and 25*d* perform an operation for output signals 16*c* and 16*d* of the position detectors 10*c* and 10*d* attached to the pistons 6*c* of the cylinders 6 and the set value 28, and its deviation is processed by controllers 24 to be the drive signal of the servo valves 7. The servo valves 7, based on the drive signal, control the excurrent/incurrent of the oil to the hydraulic cylinders 6 via the piping 8 to move the pistons 6*c* of the hydraulic cylinders 6 until the deviation becomes "0". As a result, the right and left roll gaps are set to predetermined values. Herein, the arithmetical units 11 calculates the pressing force based on the output from the pressure detectors 9*a* and 9*b* provided on the head side and rod side of the piping 8, an adding unit 26 calculates the sum of the right and left pressing force, that is, the actual pressing force 27 of the pinch rolls 1, and it is subject to comparative operation with the pressing force set value 28 by an add-subtract unit 29 to obtain the deviation.

The deviation is processed by the controller 30, and the processed value is made to be a set value 31 for the foregoing right and left control units C' and D'. With this set value, since the pinch rolls 1 are parallelly moved by the position control such that the right and left gaps of the pinch rolls 1 becomes the set pressing force, the fluctuation of the difference in the right and left gaps can be suppressed.

As described above, according to the control unit of the hydraulic pinch rolls of the present invention, the fluctuation of the roll gaps caused by the shift of the strip 4 either to the right or the left can be suppressed more certainly. As a result, the shift of the strip 4 to the right or left can be prevented and the deterioration of the coil winding shape can be prevented.

Although the present invention has been described based on a few preferred embodiments, it should be understood that the scope of right incorporated in the present invention is not limited to the embodiments. On the contrary, the scope of right of the present invention should include all improvements, modifications and equivalents.

What is claimed is:

1. A control method of hydraulic pinch rolls wherein a strip is held between upper and lower pinch rolls to guide the strip, the method comprising the steps of:

providing an upper pinch roll having end portions and a lower pinch roll, with hydraulic cylinders that independently support the end portions in an axis direction of the upper pinch roll;

adjusting an excurrent/incurrent amount of an operation oil in the hydraulic cylinders with servo valves;

detecting piston positions of the hydraulic cylinders with position detectors;

detecting a pressing force of the hydraulic cylinders with pressing force detectors; and controlling the servo valves with a right control unit and a left control unit, whereby positional control and pressing force control of the upper pinch roll is performed by controlling the servo valves, wherein set values of the pressing force control are provided for the right control unit and the left control unit, and are independently corrected by a correction value calculated based on a right difference and left difference, respectively, of the piston positions of hydraulic cylinders.

2. A control method of hydraulic pinch rolls wherein a strip is held between upper and lower pinch rolls to guide the strip, the control method comprising the steps of:

providing an upper pinch roll having end portions, and a lower pinch roll, with hydraulic cylinders that independently support each of the end portions in an axis direction of the upper pinch roll, wherein each hydraulic cylinder has a piston;

adjusting an excurrent/incurrent amount of an operation oil of the hydraulic cylinders with servo values to move the pistons;

detecting positions of the pistons of the hydraulic cylinders with position detectors to generate a first output;

detecting a pressing force of the hydraulic cylinders with pressing force detectors to generate a second output used to calculate an actual pressing force value;

processing the actual pressing force value to generate first set value input for a right control unit and a left control unit; and controlling the servo values with the right control unit and the left control unit to receive output from the position detectors and to receive the first set value input to generate a drive signal to control the servo values, whereby positional control and pressing force control of the upper pinch roll and the lower pinch roll are performed, wherein the first set value inputs of positional control are provided for the right control unit and the left control unit to move the upper pinch roll and the lower pinch roll parallelly so that a fluctuation in right and left gaps of the pinch rolls is suppressed.

3. A control unit of hydraulic pinch rolls, comprising:

position detectors disposed to detect positions of pistons of hydraulic cylinders, wherein each position detector generates a first output signal;

first add/subtract units connected to receive first output signals from the position detectors, wherein the first add/subtract units add or subtract each first output signal from the position detectors and a first set value;

first controllers connected to receive input from the first add/subtract units, wherein the first controllers process deviation of a calculated positional control value and the first output signal from a respective position detector to form a drive signal for servo valves;

servo valves disposed to control an excurrent/incurrent amount of oil to the hydraulic cylinders based on the drive signal;

pressure detectors disposed to detect pressure of piping at a head side and a rod side, wherein each pressure detector generates a second output;

arithmetical units connected to receive the second outputs from the pressure detectors, wherein the arithmetical units calculate pressing force based on the second outputs from the pressure detectors, and each arithmetical unit generates a third output;

a second add-subtract unit connected to receive summed third outputs from the arithmetical units, wherein the second add-subtract unit operates to compare, by adding or subtracting, the summed third outputs from the arithmetical units and a third set value of pressing force, and the second add-subtract unit generates a deviation output; and a second controller connected to receive the deviation output from the second add-subtract unit, wherein the second controller processes the deviation output from the second add-subtract unit to form the first set value for the control unit, whereby the hydraulic cylinders move the pinch rolls parallelly in accordance with the first set value so that fluctuation in a difference in right and left gaps of the pinch rolls is suppressed.

4. A control unit of hydraulic pinch rolls comprising:

first pressure detectors disposed in piping between a first hydraulic cylinder and a first servo valve, the first hydraulic cylinder having a first piston;

a first arithmetical unit connected to receive input from the pressure detectors, wherein the first arithmetical unit performs an operation for calculating a pressing force generated by the first hydraulic cylinder using pressure of the first hydraulic cylinder at a head side and a rod side, wherein the pressure is detected by the pressure detectors and the first arithmetical unit generates a first calculated value output corresponding to the pressing force;

a first controller connected to receive the first calculated value output from the first arithmetical unit and to send output to the first servo valve, the first controller operating to compare and process the first calculated value output corresponding to the pressing force and a pressing force set value, wherein the first servo valve is driven based on the output from the first controller and the first servo valve operates to control an excurrent/incurrent amount of oil to the first hydraulic cylinder in order to control the pressing force generated by the first hydraulic cylinder to a predetermined value;

position detectors disposed to detect positions of the first piston of the first hydraulic cylinder and a second piston of a second hydraulic cylinder, each position detector generating an output;

a second arithmetical unit connected to receive output from the position detectors, wherein the second arithmetical unit performs an operation for processing a difference of output from the position detectors, and generates a second calculated value output; and a second controller connected to receive the second calculated value output from the second arithmetical unit, wherein the second controller operates to process the second calculated value output to generate correction output, and the first controller includes a first add/subtract unit connected to receive the correction output from the second controller, wherein when the first add/subtract unit operates to add the correction output to the pressing force set value, the first controller drives the first servo to push an end portion of the pinch rolls having a wider first gap in a direction to push down the first gap, and the correction output is received by a second add/subtract unit of a third controller connected to drive a second servo valve, wherein the second servo valve operates to control an excurrent/incurrent amount of oil to the second hydraulic cylinder in order to control the pressing force generated by the second hydraulic cylinder to a predetermined value, wherein the second add/subtract unit operates to subtract the correction output from the pressing force set value, and the third controller drives the second servo to push lighter on an opposite end portion of the pinch rolls having a second gap, whereby set values of pressing force control provided for the first and second gaps are independently corrected.

5. The control unit according to claim 4, wherein said second controller includes a main arithmetical unit comprising a high-pass filter, a control gain and a clamping circuit.

* * * * *